US009217581B1

(12) United States Patent
Merideth

(10) Patent No.: US 9,217,581 B1
(45) Date of Patent: Dec. 22, 2015

(54) AIR CONDITIONER SUPPORT SYSTEM

(71) Applicant: Mark Ray Merideth, Roseville, CA (US)

(72) Inventor: Mark Ray Merideth, Roseville, CA (US)

(73) Assignee: Uni-Products, Inc., North Highlands, CA (US)

( * ) Notice: Subject to any disclaimer, the term of this patent is extended or adjusted under 35 U.S.C. 154(b) by 0 days.

(21) Appl. No.: 14/480,851

(22) Filed: Sep. 9, 2014

(51) Int. Cl.
*A47G 29/02* (2006.01)
*F24F 13/32* (2006.01)

(52) U.S. Cl.
CPC ..... *F24F 13/32* (2013.01)

(58) Field of Classification Search
CPC ..... F27D 1/14; F24F 1/50; F24F 1/0007; F24F 2013/0616; F24F 13/32
See application file for complete search history.

(56) References Cited

U.S. PATENT DOCUMENTS 3,065,572 A * 11/1962 Weingartner ..... 52/62
4,779,751 A * 10/1988 Munroe ..... 217/69

* cited by examiner

*Primary Examiner* — Amy Sterling
(74) *Attorney, Agent, or Firm* — Thomas R. Lampe

(57) ABSTRACT

An air conditioner support includes a curb frame having side walls forming corners and a support bracket at each corner secured to end portions of the side walls. End portions of adjacent side walls are sandwiched between an inner bracket segment and an outer bracket segment and secured in place by threaded fasteners.

13 Claims, 2 Drawing Sheets

AIR CONDITIONER SUPPORT SYSTEM

TECHNICAL FIELD

This invention relates to an air conditioner support system and more particularly to an air conditioner support including support brackets for supporting an air conditioner curb frame.

BACKGROUND OF THE INVENTION

Support devices known as curbs are commonly employed to mount air conditioners on the roof of a building or other surfaces. Typically, curbs are pre-manufactured and assembled in their entirety off site and then conveyed to the location of installation. It will be appreciated that these curbs can be quite bulky and unwieldy. Furthermore, conventional pre-manufactured and assembled curbs can be of relatively unsubstantial structural character, causing stability and other support problems when employed.

That is, such prior art lightweight, preassembled curbs can be of inadequate structural strength to resist deformation or failure thereof when supporting an air conditioner in the case of earthquake or application of other comparable forces.

DISCLOSURE OF INVENTION

The present invention relates to an air conditioner support including support brackets located at the corners of a curb frame to strengthen and stabilize the air conditioner support. Furthermore, the air conditioner support curb frame can be assembled at a work site along with support brackets located at the corners of the curb frame. The curb of the present invention is also characterized by its high strength and resistance to deformation upon application of seismic and other comparable forces thereto.

The ability of the air conditioner support of the present invention to be shipped with the components thereof unassembled allows more efficient use of transport equipment and storage facilities.

The air conditioner support of the present invention is for mounting an air conditioner on a roof or other surface to support the air conditioner.

The combination of the air conditioner support includes a curb frame having an upper curb frame portion and a plurality of curb frame side walls having side wall end portions, the curb frame side walls extending downwardly from the upper curb frame portion and forming corners.

A support bracket is located at each of the corners. The support bracket structure is of unique character, the support bracket having an inner bracket segment and an outer bracket segment extending upwardly from a bracket base.

The inner bracket segment has an upper inner bracket segment end and a lower inner bracket segment end.

The outer bracket segment has an upper outer bracket segment end and a lower outer bracket segment end.

End portions of adjacent curb frame side walls at each corner are operatively associated with a support bracket and extend between the upper inner bracket segment end and the upper outer bracket segment end. The side wall end portions are sandwiched between the inner bracket segment and the outer bracket segment and fasteners secure the curb frame side wall end portions to their respective support brackets.

Other features, advantages and objects of the present invention will become apparent with reference to the following description and accompanying drawings.

BEST MODE FOR CARRYING OUT THE INVENTION

Figure 1:
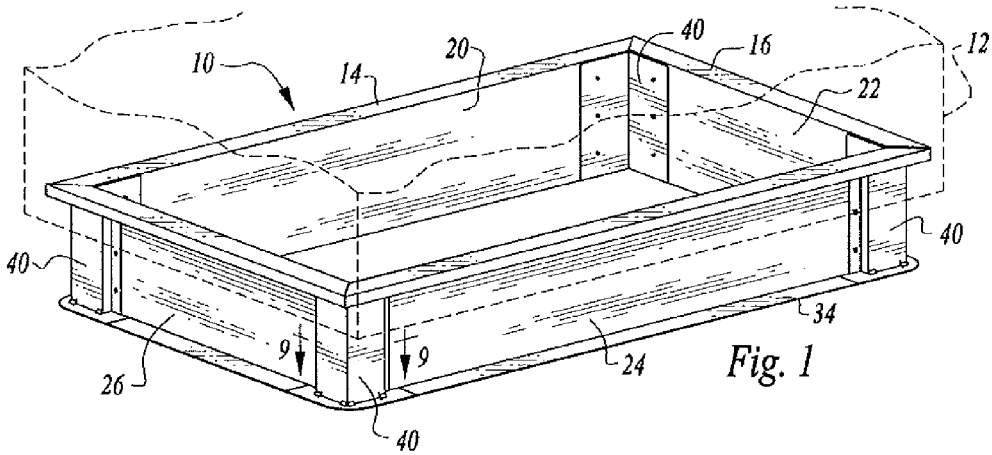
FIG. 1 is a perspective view of an air conditioner support constructed in accordance with the teachings of the present invention supporting an air conditioner, only a portion of the air conditioner being illustrated by dash lines.
Figure 2:
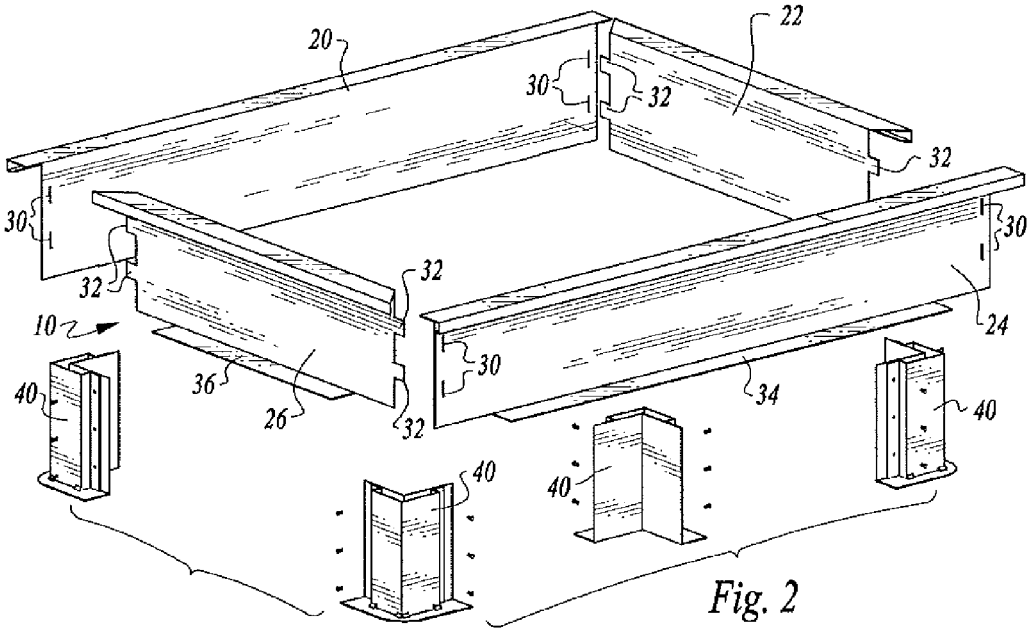
FIG. 2 is an exploded, perspective view illustrating an unassembled curb frame and four support brackets constructed in accordance with the teachings of the present invention prior to assembly with the curb frame.
Figure 3:
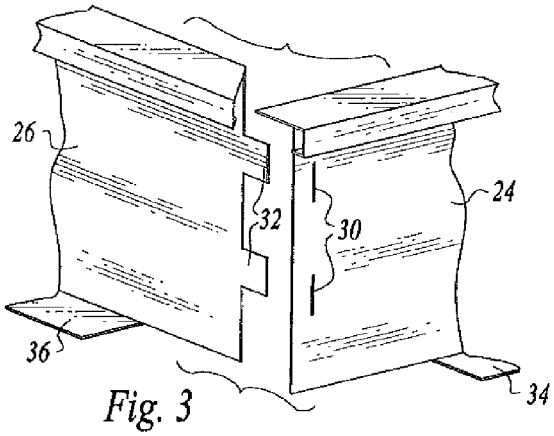
FIG. 3 is a greatly enlarged, perspective view showing end portions of adjacent curb frame side walls prior to engagement.

Referring now to the drawings, an air conditioner support constructed in accordance with the teachings of the present invention is identified by reference numeral 10. The air conditioner support is for mounting an air conditioner on a roof or other surface to support the air conditioner. In FIG. 1 dash lines are used to depict a bottom portion of air conditioner 12.

The air conditioner support 10 includes a curb frame 14 having an upper curb frame portion 16 and four curb frame side walls 20, 22, 24, 26 extending downwardly from the upper curb frame portion and forming four corners. The curb frame may be formed of any suitable sheet metal.

Figure 4:
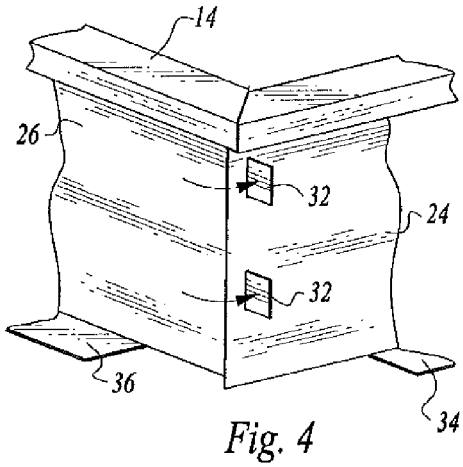
FIG. 4 is a view similar to FIG. 3, but showing the side wall end portions brought together but not yet completely connected.
Figure 5:
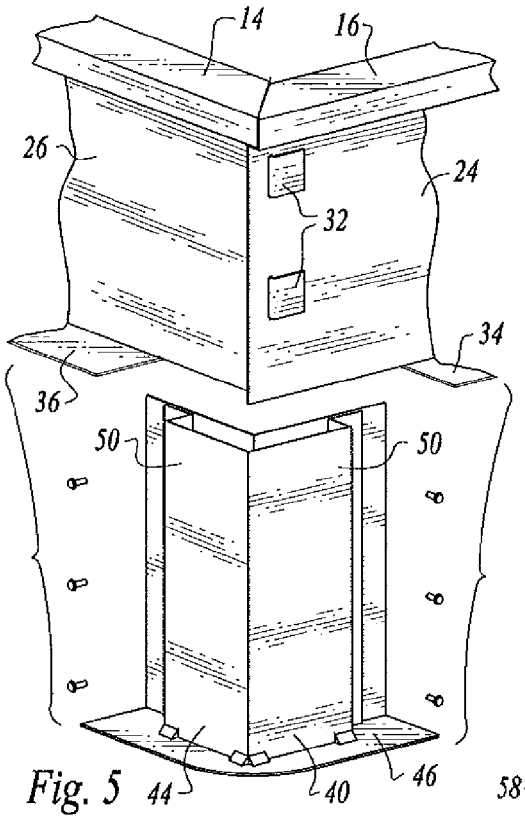
FIG. 5 is a perspective, exploded view showing the two side wall end portions connected together and prior to connection to a support bracket.
Figure 6:
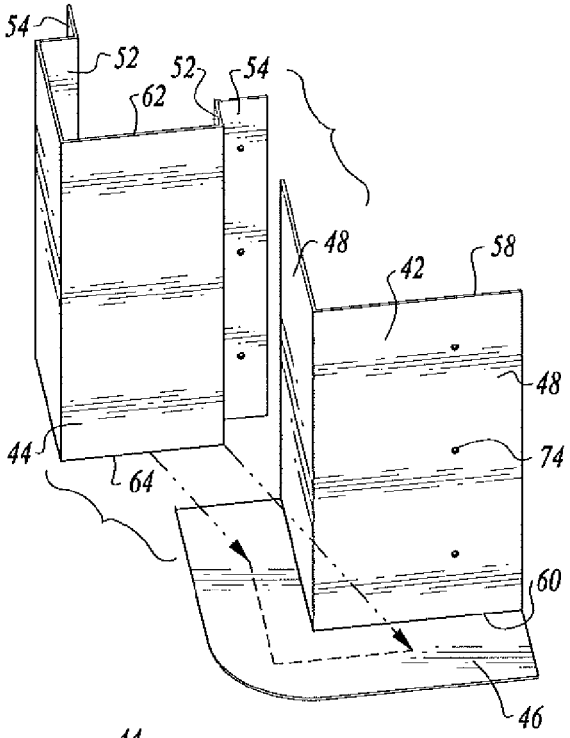
FIG. 6 is an exploded, perspective view illustrating two structural components of the support bracket prior to assembly of the support bracket.
Figure 7:
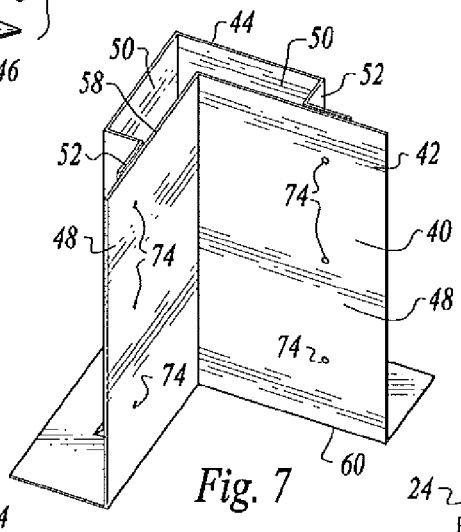
FIG. 7 is a top, rear perspective view of the assembled support bracket.
Figure 8:
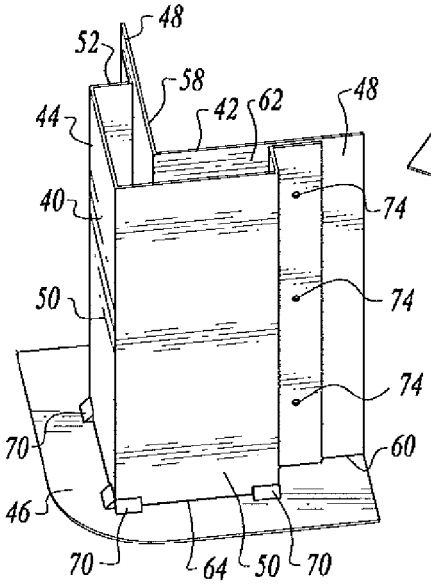
FIG. 8 is a view similar to FIG. 7, but showing the assembled support bracket as viewed from the front.

The curb frame side walls may be brought to the site in disassembled condition and readily assembled. In the arrangement illustrated, curb frame side walls 20, 24 have slots 30 formed in the end portions thereof. Curb frame side walls 22, 26 have tabs 32 projecting outwardly from the end portions thereof which are inserted into the slots of side walls 20, 24 and bent as shown in FIG. 4 to bring the end portions of the curb frame side walls into locked engagement.

Curb frame 14 also includes base flanges extending outwardly from bottom edges of the curb frame side walls. FIGS. 1-5 show base flange 34 attached to curb frame side wall 24 and base flange 36 attached to and extending outwardly from curb frame side wall 26. Base flanges (not shown) also extend outwardly from side walls 20, 22.

An important feature of the present invention is the use of support brackets 40 of a specified structural character which are located at each of the corners formed by the curb frame side walls. The support brackets may be formed of any suitable sheet metal material.

Each support bracket 40 has an inner bracket segment 42 and an outer bracket segment 44 extending upwardly from a bracket base 46.

The inner bracket segment has two inner bracket segment panels 48 disposed substantially orthogonal to one another.

Each outer bracket segment includes two outer bracket segment panels 50 disposed orthogonal to one another. Side panels 52 are connected to the two outer bracket segment panels and extend toward the inner bracket segment panels 48. Also, the outer bracket segment 44 includes two flanges 54 extending outwardly from the side panels 52.

The inner bracket segment 42 has an upper inner bracket segment end 58 and a lower inner bracket segment end 60.

Figure 9:
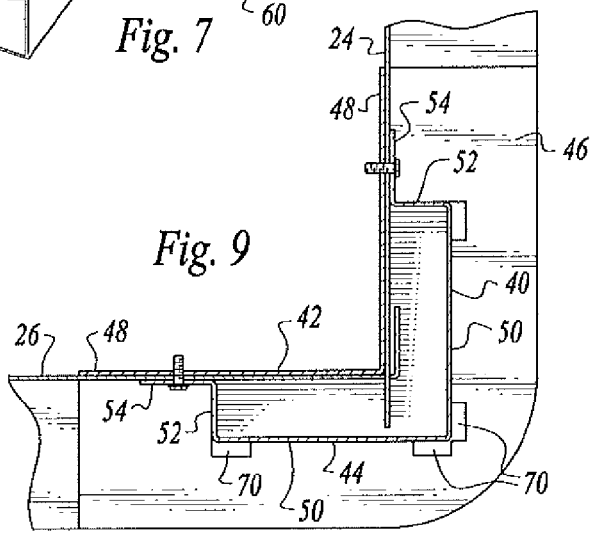
FIG. 9 is a greatly enlarged, sectional view taken along the line 9-9 of FIG. 1.

The outer bracket segment 44 has an upper outer bracket segment end 62 and a lower outer bracket segment end 64. In the support bracket 40 the bracket base 46 comprises a base plate integral with and affixed to the two inner bracket segment panels 48, extending laterally outwardly therefrom. The lower outer bracket segment end 64 of the outer bracket segment 44 is welded or otherwise affixed to the base plate at locations 70. However, the upper inner bracket segment end 58 and the upper outer bracket segment end 62 are not secured together and instead form an opening when pulled or pushed apart, enabling end portions of adjacent curb frame side walls at the corner associated with a support bracket to move downwardly relative to the bracket between the inner bracket segment and the outer bracket segment whereby the side wall end portions are sandwiched between the inner bracket segment and the outer bracket segment as shown in FIG. 9. When the curb frame side walls are all in place relative to the four support brackets, fasteners are employed to secure the curb frame side wall end portions to their respective support brackets.

In the arrangement illustrated, holes 74 formed in the curb frame side wall end portions, the inner bracket segment panels 48 and the flanges 54 of the outer bracket segment are aligned. Threaded fasteners in the form of sheet metal screws are inserted into the aligned holes and employed to fasten the bracket and curb frame together.

The bracket 40 provides a very strong and stable air conditioner support at each corner, strengthening and stabilizing the curb as a whole.

The invention claimed is:

1. An air conditioner support for mounting an air conditioner on a roof or other surface to support the air conditioner, said air conditioner support comprising, in combination:

a curb frame having an upper curb frame portion and a plurality of curb frame side walls having side wall end portions, said curb frame side walls extending downwardly from said upper curb frame portion and forming corners;

a support bracket located at each of said corners, each support bracket having an inner bracket segment and an outer bracket segment extending upwardly from a bracket base, said inner bracket segment having an upper inner bracket segment end and a lower inner bracket segment end, and said outer bracket segment having an upper outer bracket segment end and a lower outer bracket segment end, said lower inner bracket segment end and said lower outer bracket segment end being welded together, with the inner bracket segment and the outer bracket segment otherwise being separated and defining a space therebetween, end portions of adjacent curb frame side walls at each corner operatively associated with a support bracket and extending through the upper inner bracket segment end and the upper outer bracket segment end thereof into the space defined thereby and sandwiched between and in engagement with said inner bracket segment and said outer bracket segment thereof; and fasteners securing the curb frame side wall end portions to their respective support brackets extending through the curb frame side walls and the inner and outer bracket segments, said support brackets being formed of sheet metal and said fasteners comprising mechanical fasteners extending through aligned openings in the curb frame side walls, the outer bracket segments and the inner bracket segments maintaining the curb frame side walls, the outer bracket segments and the inner bracket segment in fixed engagement.

2. The air conditioner support according to claim 1 wherein each inner bracket segment includes two inner bracket segment panels disposed substantially orthogonal to one another.

3. The air conditioner support according to claim 2 wherein each outer bracket segment includes two outer bracket segment panels disposed substantially orthogonal to one another, side panels connected to said two outer bracket segment panels and extending toward said inner bracket segment panels, and two flanges extending outwardly from said side panels, said flanges in engagement with side wall end portions of adjacent curb frame side walls, with the curb frame side walls sandwiched between said inner bracket segment panels and said flanges.

4. The air conditioner support according to claim 2 wherein said bracket base comprises a base plate affixed to and extending laterally outwardly from said two inner bracket segment panels.

5. The air conditioner support according to claim 4 wherein said outer bracket segment is positioned on said base plate, extends upwardly therefrom and is secured to said base plate at a bottom edge of said outer bracket segment.

6. The air conditioner support according to claim 5 wherein said curb frame additionally includes base flanges extending outwardly from bottom edges of said curb frame side walls.

7. The air conditioner support according to claim 6 wherein said base flanges are disposed between base plates of said support brackets.

8. A curb frame support bracket at least partially formed of sheet metal for use in an air conditioner support for mounting an air conditioner on a roof or other surface to support the air conditioner, said air conditioner support including a curb frame having an upper curb frame portion and a plurality of curb frame side walls having side wall end portions, said curb frame side walls extending downwardly from said upper curb frame portion and forming corners, said curb frame support bracket for positioning at one of said corners and including an inner bracket segment and an outer bracket segment extending upwardly from a bracket base, said inner bracket segment having an upper inner bracket segment end and a lower inner bracket segment end, and said outer bracket segment having an upper outer bracket segment end and a lower outer bracket segment end, said curb frame support bracket configured to receive end portions of adjacent curb frame side walls at said corner with said end portions extending between the upper inner bracket segment end and the upper outer bracket segment end thereof and sandwiched between said inner bracket segment and said outer bracket segment thereof with fasteners securing the curb frame end portions to the curb frame support bracket, said inner bracket segment including two inner bracket segment panels disposed substantially orthogonal to one another, said outer bracket segment including two outer bracket segment panels disposed substantially orthogonal to one another, side panels connected to said two outer bracket segment panels and extending toward said inner bracket segment panels, and two flanges extending outwardly from said side panels, said flanges for engagement with side wall end portions of adjacent curb frame side walls, with the curb frame side walls sandwiched between said inner bracket segment panels and said flanges, holes formed in said flanges and said inner bracket segment panels for alignment with holes in curb frame side walls for receiving said fasteners.

9. The curb frame support bracket according to claim 8 wherein said bracket base comprises a base plate affixed to and extending laterally outwardly from said two inner bracket segment panels.

10. The curb frame support bracket according to claim 9 wherein said outer bracket segment is positioned on said base plate, extends upwardly therefrom and is secured to said base plate at a bottom edge of said outer bracket segment.

11. The curb frame support bracket according to claim 10 wherein the bottom edge of said outer bracket segment is welded to said base plate.

12. An air conditioner support for mounting an air conditioner on a roof or other surface to support the air conditioner, said air conditioner support comprising, in combination:

a curb frame having an upper curb frame portion and a plurality of curb frame side walls having side wall end portions, said curb frame side walls extending downwardly from said upper curb frame portion and forming corners, said curb frame side wall end portions incorporating slot and tab connector structure for connecting adjacent curb side frame walls;

a support bracket located at each of said corners, each support bracket having an inner bracket segment and an outer bracket segment extending upwardly from a bracket base, said inner bracket segment having an upper inner bracket segment end and a lower inner bracket segment end, and said outer bracket segment having an upper outer bracket segment end and a lower outer bracket segment end, end portions of adjacent curb frame side walls at each corner operatively associated with a support bracket and extending between the upper inner bracket segment end and the upper outer bracket segment end thereof and sandwiched between said inner bracket segment and said outer bracket segment thereof; and fasteners securing the curb frame side wall end portions to their respective support brackets.

13. An air conditioner support for mounting an air conditioner on a roof or other surface to support the air conditioner, said air conditioner support comprising, in combination:

a curb frame having an upper curb frame portion and a plurality of curb frame side walls having side wall end portions, said curb frame side walls extending downwardly from said upper curb frame portion and forming corners, said curb frame side wall end portions incorporating slot and tab connector structure for connecting adjacent curb side frame walls;

a support bracket located at each of said corners, each support bracket having an inner bracket segment and an outer bracket segment extending upwardly from a bracket base, said inner bracket segment having an upper inner bracket segment end and a lower inner bracket segment end, and said outer bracket segment having an upper outer bracket segment end and a lower outer bracket segment end, end portions of adjacent curb frame side walls at each corner operatively associated with a support bracket and extending between the upper inner bracket segment end and the upper outer bracket segment end thereof and sandwiched between said inner bracket segment and said outer bracket segment thereof; and fasteners securing the curb frame side wall end portions to their respective support brackets, each inner bracket segment including two inner bracket segment panels disposed substantially orthogonal to one another, and said bracket base comprising a base plate affixed to and extending laterally outwardly from said two inner bracket segment panels, said outer bracket segment positioned on said base plate, extending upwardly therefrom and secured to said base plate at a bottom edge of said outer bracket segment, and said curb frame additionally including base flanges extending outwardly from bottom edges of said curb frame side walls.

* * * * *